US010633877B2

(12) United States Patent
Wolff

(10) Patent No.: US 10,633,877 B2
(45) Date of Patent: Apr. 28, 2020

(54) SYSTEM AND METHOD OF MANUFACTURING TRANSPORTABLE BUILDINGS

(71) Applicant: James L. Wolff, Pompano Beach, FL (US)

(72) Inventor: James L. Wolff, Pompano Beach, FL (US)

( * ) Notice: Subject to any disclaimer, the term of this patent is extended or adjusted under 35 U.S.C. 154(b) by 0 days.

(21) Appl. No.: 16/550,008

(22) Filed: Aug. 23, 2019

(65) Prior Publication Data

US 2019/0376303 A1 Dec. 12, 2019

Related U.S. Application Data

(63) Continuation of application No. 15/168,009, filed on May 28, 2016, now abandoned.

(60) Provisional application No. 62/171,428, filed on Jun. 5, 2015.

(51) Int. Cl.

| | |
|---|---|
| ***E04H 1/00*** | (2006.01) |
| ***E04H 1/12*** | (2006.01) |
| ***E04B 1/343*** | (2006.01) |
| ***E02D 27/38*** | (2006.01) |
| ***F24F 13/02*** | (2006.01) |
| ***E04B 1/348*** | (2006.01) |
| ***E05B 65/00*** | (2006.01) |
| ***E02D 27/02*** | (2006.01) |
| ***F24F 1/04*** | (2011.01) |
| ***F21V 33/00*** | (2006.01) |
| *F21W 131/10* | (2006.01) |

(52) U.S. Cl.

CPC ..... *E04H 1/005* (2013.01); *E02D 27/02* (2013.01); *E02D 27/38* (2013.01); *E04B 1/348* (2013.01); *E04B 1/34315* (2013.01); *E04H 1/1205* (2013.01); *E05B 65/00* (2013.01); *F21V 33/006* (2013.01); *F24F 1/04* (2013.01); *F24F 13/0272* (2013.01); *E04H 2001/1283* (2013.01); *F21W 2131/1005* (2013.01)

(58) Field of Classification Search

None

See application file for complete search history.

(56) References Cited

U.S. PATENT DOCUMENTS

| | | | | |
|---|---|---|---|---|
| 3,118,187 A * | 1/1964 | Alimanestiano | E04B 1/343 | 52/34 |
| 3,540,173 A * | 11/1970 | Johnides | E04B 1/348 | 52/79.5 |
| 4,854,094 A * | 8/1989 | Clark | E04B 1/3483 | 52/79.1 |
| 5,735,639 A * | 4/1998 | Payne | B65D 90/18 | 405/129.57 |
| 7,827,738 B2 * | 11/2010 | Abrams | E04B 1/003 | 52/79.1 |

(Continued)

*Primary Examiner* — Brian E Glessner
*Assistant Examiner* — Adam G Barlow
(74) *Attorney, Agent, or Firm* — Nancy J. Flint, Attorney At Law, P.A.; Nancy J. Flint, Esq.

(57) ABSTRACT

A transportable building comprising a modular element constructed from a plurality of steel or aluminum intermodal shipping containers is disclosed. The method of manufacture greatly reduces the cost of constructing the transportable building. The transportable building can be set up at a site and later easily dismantled and moved, providing flexibility to temporarily set up a business without the need to build and maintain a permanent structure.

13 Claims, 4 Drawing Sheets

(56) References Cited

U.S. PATENT DOCUMENTS

| | | | | |
|---|---|---|---|---|
| 8,826,600 | B2 * | 9/2014 | Wallance | E04B 1/003 52/79.1 |
| 10,131,409 | B2 * | 11/2018 | Loudrup | E04B 1/34336 |
| 2008/0053992 | A1 * | 3/2008 | DeBord | E04H 1/1205 220/1.6 |
| 2014/0298745 | A1 * | 10/2014 | Rechenmacher | E04B 1/161 52/425 |
| 2015/0368035 | A1 * | 12/2015 | Di Franco | B65D 88/005 220/4.01 |
| 2016/0069064 | A1 * | 3/2016 | Martin | E04H 1/005 52/79.7 |
| 2016/0273271 | A1 * | 9/2016 | Morrell | B23P 6/00 |
| 2017/0121990 | A1 * | 5/2017 | Armstrong | E04B 1/34331 |

* cited by examiner

SYSTEM AND METHOD OF MANUFACTURING TRANSPORTABLE BUILDINGS

FIELD OF THE INVENTION

The invention relates to a transportable building manufactured from a plurality of steel or aluminum intermodal shipping containers assembled into modular elements. The method of manufacture greatly reduces the cost of constructing the transportable building. The transportable building can be set up temporarily at a site and later easily dismantled and moved. The invention thus provides flexibility to temporarily set up a business without the need to build and maintain a permanent structure.

BACKGROUND OF THE INVENTION

Intermodal shipping containers have been used for cargo transportation since the 1930s in Europe, with standardized containers used in the United States in the 1950s. "Intermodal" indicates that the container can be used across various modes of transport, (from ship to rail to truck) without unloading and reloading its contents. There are about seventeen million intermodal containers in the world, and a large proportion of the world's long-distance freight generated by international trade is transported in shipping containers. Much freight is now shipped overseas in intermodal containers of standard sizes; usually eight and one-half nine and one-half (8½-9½) feet high, eight (8) feet wide and twenty (20) or forty (40) feet long, although there exists many more variations of these intermodal shipping containers.

A typical container has doors fitted at one end and is made of corrugated weathering steel (commonly referred to as COR-TEN®, a federally registered trademark of U.S. Steel Corporation) with a plywood floor.

Shipping containers are a reusable transport and storage unit for moving products and raw materials between locations or countries. A large proportion of the world's long-distance freight generated by international trade is transported in shipping containers. It is estimated that several million of these containers have been discarded due to the shipping cost of sending them back to their port of origin.

These shipping containers are very strong, having been manufactured to stack up to seven units high during shipping and to carry heavy loads. However, after use they become uneconomical to use as shipping containers and they are taken out of service.

Shipping container architecture, or "cargotechture," is a form of architecture using intermodal shipping containers as a structural element. The advantages of using shipping containers for transportable buildings include:

- Strength and durability: shipping containers are designed to carry heavy loads and to be stacked in high columns. They are also designed to resist harsh environments.
- Modularity: shipping containers have the same width and most have standard height and length measurements which simplifies design, planning and transport. They are designed to interlock for ease of mobility during transportation and for structural construction.
- Labor: overall welding and cutting of steel is less expensive than conventional construction.
- Transport: shipping containers are easily transported by ship, truck or rail, because they already conform to standard shipping sizes.

- Availability: used shipping containers are available across the globe.
- Expense: used containers are often available at an amount that is low compared to a finished structure built by other labor-intensive means such as bricks and mortar—which also require larger more expensive foundations.
- Foundations: shipping containers are designed to be supported by their four corners making a simple foundation possible.
- Eco-Friendly: recycling of shipping containers saves on use of traditional building materials.

Several structures based on shipping containers have already been constructed, and their uses, sizes, locations and appearances vary widely. Stewart Brand, the author of the book How Buildings Learn, converted a shipping container into office space, and wrote up the conversion process in the book. In 2006, Southern California Architect Peter DeMaria, designed a two story shipping container home under the guidelines of the Uniform Building Code (UBC). In 2007, Logical Homes created the Aegean for the Computer Electronics Show in Las Vegas, Nev. Other architects, such as Adam Kalkin have built original homes, using discarded shipping containers for their parts or using them in their original form, or doing a mix of both.

In 2000, the firm Urban Space Management completed the project called Container City I in the Trinity Buoy Wharf area of London. In 2006, the Dutch company Tempohousing finished in Amsterdam the biggest container village in the world: 1,000 student homes from modified shipping containers from China.

In 2002 standard ISO shipping containers began to be modified and used as stand-alone on-site wastewater treatment plants. The use of containers creates a cost-effective, modular, and customizable solution to on-site waste water treatment and eliminates the need for construction of a separate building to house the treatment system.

Brian McCarthy, an MBA student, developed prototypes of shipping container housing for maquiladora workers in Mexico.

in 2010 German Architect and Production Designer, Stefan Beese, utilized six 40' long shipping containers to create a large viewing deck and a VIP lounge area for use as a grand stand scaffold structure at the Voodoo Music Experience, New Orleans. The containers also provide storage space for other festival components throughout the year. The two top containers are cantilevered nine feet on each side creating two balconies that are prime viewing locations. There are also two bars located on the balconies. Each container was perforated with cutouts spelling the word "VOODOO," which not only brands the structure but creates different vantage points and service area openings.

In the United Kingdom, walls of containers filled with sand have been use as giant sandbags to protect against the risk of flying debris from exploding ceramic insulators in electricity substations.

In the October 2013, two barges owned by Google with superstructures made out of shipping containers received media attention speculating about their purpose.

The biggest shopping mall/market in Europe is made up of alleys formed by stacked containers, on 170 acres of land between the airport and the central part of Odessa, Ukraine. Informally named "Tolchok" and officially known as the Seventh-Kilometer Market it has 16,000 vendors and employs 1,200 security guards and maintenance workers. In Central Asia, the Dordoy Bazaar in Bishkek, Kyrgyzstan is composed almost entirely of double-stacked containers. In 2011, the Cashel Mall in Christchurch, New Zealand reopened in a series of shipping containers months after it had been destroyed in the earthquake that devastated the city's central business district. Starbucks Coffee has also built a store using shipping containers.

U.S. Pat. No. 4,854,094, issued to Clark on Aug. 8, 1989, discloses a method comprising mounting at least one standard steel shipping container on a weight-bearing foundation at the ends; installing a roof, a raised floor and a dropped ceiling; and at least one window opening and one door opening in the side and end walls, with a window and a door installed therein. The building is constructed at the building site.

SUMMARY OF THE INVENTION

The invention relates to a method for converting a steel or aluminum intermodal shipping container to a transportable building through assembly of the shipping containers into "modular elements." Assembly, disassembly and movement of these modular elements into place for construction of the transportable building is easily and rapidly accomplished using the already in-place system used to move shipping containers daily in the commerce system.

The system and method of the invention comprises assembling three standard intermodal shipping containers into a single modular element to be used for construction of a transportable building. In one embodiment, a plurality of modular elements can be assembled into a transportable building.

According to one embodiment of the invention, a transportable building comprises three modular elements abutting each other at side walls in a side-by-side relationship. In one embodiment, the transportable building comprises a plurality of modular elements placed in end-to-end abutment. The modular elements are sealed at the points of abutment.

Each modular element comprising the transportable building may be removably connected to a foundation, wherein the foundation may comprise a slab or a plurality of footings.

In one embodiment, a plurality of walls is constructed within the interior of one or more of the modular elements to form a plurality of individual units. The individual units may be the same size, or may vary in size.

Doorways are cut out of the adjacent sidewalls of the modular elements to allow entry into each individual unit.

At one end of one the modular elements, an entryway, or alcove, is built that includes security features to gain access to the interior of the transportable building and thus to the doors of the individual units.

All of the materials needed in addition to the shipping containers for construction of the modular elements may be placed within the shipping containers and then delivered to the building site where the transportable building is constructed. In one embodiment, the shipping containers may be modified to modular elements that contain a plurality of individual units at a remote site and then delivered to a site for installation as a transportable building. At the installation site, the modular elements are set in place on a foundation and sealed to form the transportable building.

Modular elements may be joined in a vertical array to produce any of various arrangements for a second or higher level in the transportable building.

Each transportable building may contain electrical, insulation, HVAC and architectural features as needed and/or desired for each environment, as selected by the owner or as mandated by applicable building code. The transportable building may be further improved with the installation of decorative interior walls, weather-resistant exterior covering, exterior security lights or any features as determined by the owner.

The only permanent structures that may be required for installation of the transportable building are the footings upon which to place the modular elements. The transportable buildings can be built with a small investment in materials and labor. The transportable building can be dismantled, then easily transported to a new location. The footings may be removed, leaving the land in its original condition.

BRIEF DESCRIPTION OF DRAWINGS

The invention will be described with reference to the accompanying drawings.

DETAILED DESCRIPTION OF THE INVENTION

Figure 1:
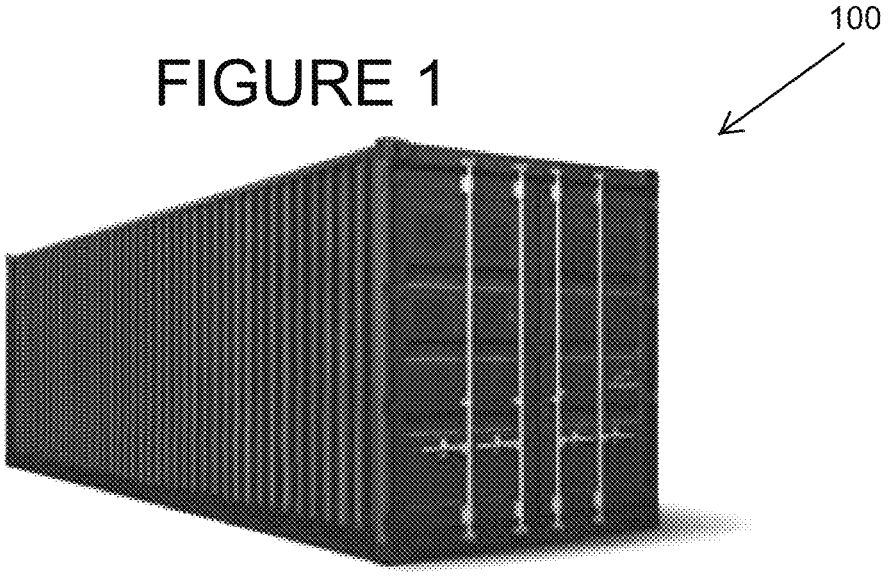
FIG. 1 depicts a standard intermodal shipping container.

The invention relates to a method for converting a steel or aluminum intermodal shipping container to a transportable building through assembly of the shipping containers into "modular elements." Assembly, disassembly and movement of the modular elements into place is easily and rapidly accomplished using the already in-place system used to move shipping containers daily in the commerce system.

Each modular element is constructed of three (3) standard intermodal shipping containers. The understructure of a standard intermodal shipping container comprises four (4) vertical structure members, or corner posts, extending the height of the shipping container; two (2) top end rails extending between two (2) corner posts at the top of the corner post at each end of the shipping container and two (2) bottom end rails extending between two (2) corner posts at the bottom of the corner post at each end of the shipping container, thus forming a front end frame and a rear end frame; two (2) top side rails extending between two (2) corner posts at the top of the front end frame and two (2) bottom side rails extending between two (2) corner posts of the bottom end frame; and a plurality of cross members for supporting flooring extending between the two (2) bottom side rails. Specifications are defined in ISO 1161. The basic structure may further comprise a lateral structural member situated over a door opening and joined to the corner fittings in the rear end frame. The understructure may further comprise forklift pockets comprising a plurality of reinforced tunnels (installed in pairs) situated transversely across the understructure and providing openings in the bottom side rails at ISO prescribed positions to enable either empty capacity or empty and loaded capacity container handling by forklift equipment.

The standard intermodal shipping container further comprises walls, a roof and a floor. The floor typically comprises Fiberglass Reinforced Plywood (FRP) constructed of laminates of fiberglass, polyester resins, and plywood, also known as sandwich panel. Corrugated or flat sheet steel, a riveted or bonded aluminum sheet and wall post assembly, FRP, foam and beam, aluminum, or honeycomb material and form the side wall panels or end wall panels. The roof comprises roof panels made of corrugated or flat sheet steel, sheet aluminum, FRP, or foam and beam and aluminum honeycomb panel that forms the top closure of the shipping container. The interior walls of the shipping container are often lined with plywood or similar material attached to protect the walls and/or cargo and facilitate loading operations. Shipping containers may also include a lining shield comprising a strip of thin metal installed at the bottom of the interior walls to protect the lower portion of the lining from damage by materials handling equipment during loading or unloading operations such as a kick plate installed on the lower portion of the interior front end wall; a ventilator to provide openings for the exchange of air between the outside and the container interior; one or more roof bows comprising lateral non-structural member attached to the top side rails and supporting the underside of the roof panel; a threshold plate (or crash plate) situated forward of the door sill to protect the entrance area of the container floor; steps used to gain access to the roof; and a striker plate disposed on the exterior of the roof panel adjacent to the top corner fittings that provides protection to the roof panel or top rail components from misaligned handling equipment.

A typical intermodal shipping container may be 20 feet, 8 feet wide and 8½-9½ feet high, with a maximum gross weight of 66139 pounds. Forty (40) foot long shipping containers also are also manufactured similarly with an 8 foot width and an 8½-9½ foot height. A 40 foot long shipping container likewise has a maximum gross weight of 66139 pounds. Non-standard sizes are also manufactured.

The system and method of the invention comprise assembling three standard shipping containers into a single modular element for use as a transportable building. In one embodiment, a plurality of modular elements can be assembled into a transportable building.

According to one embodiment of the invention, a transportable building comprises a modular element made of three shipping containers abutting each other at side walls in a side-by-side relationship. The modular element thus comprises two outer shipping containers and one inner shipping container. The point of abutment between each sidewall is sealed at the corner posts once each shipping container is placed on a foundation where the transportable building is to be located. The shipping containers are also sealed at adjacent rooflines by any method now known or later developed.

Each shipping container comprising the modular element may be removably connected to the foundation. In one embodiment, the modular elements are not connected to the foundation.

Once the shipping containers are connected at the sidewalls, the end doors of the two outer shipping containers can be sealed. In each embodiment, a plurality of walls is constructed within the interior of each outer shipping container to form a plurality of individual units. The individual units may be the same size, or may vary in size.

Doorways are cut out of the adjacent sidewalls of the outer shipping containers and the inner shipping container to allow entry into each individual unit. A door may be hung on hinges or using any other technique now known or later developed to hang a door in each doorway. In one embodiment, overhead roll-up doors may be used. In one embodiment, the majority of the sidewalls of the inner shipping container are removed leaving only the adjacent sidewalls of the outer shipping containers which must be cut to create the doorways. In one embodiment, the majority of the sidewalls of the outer shipping containers are removed leaving only the adjacent sidewalls of the inner shipping container which must be cut to create the doorways. A method of locking each door to secure each individual unit is also installed.

Once the three shipping containers are connected and modified as described above, the exteriors of the sidewalls of the modular element can be insulated using foam slabs or any other type of insulating material desired by the owner. The foam slabs can be glued to the exterior of the sidewalls and then painted as desired. Branding can be included on the exterior of the sidewalls if desired. In one embodiment, the interior walls may also be insulated.

At one end of the inner shipping container in the modular element, an entryway, or alcove, is built that includes security features to gain access to the interior of the inner shipping container and thus to the doors of the separate individual units. The security features may include locks, passwords, biometrics, card swipes, or any other security feature or combination of security features as desired by the owner. An alarm may be included as a security feature that is triggered by attempts at unauthorized access to the interior of the inner module or to any specific individual unit within the transportable building. Cameras may also be installed as a security feature.

In one embodiment, the transportable building comprises a plurality of modular elements as previously described, where the modular elements are placed in side-by-side abutment. The modular elements are sealed at the points of abutment along the walls and the rooflines of adjacent modular elements. In one embodiment, the modular elements are sealed by the use of bolts. In one embodiment, the modular elements are sealed by the use of approximately 1 inch diameter bolts.

In one embodiment, the transportable building comprises a plurality of modular elements as previously described, where the modular elements are placed in end-to-end abutment. The modular elements are sealed at the points of abutment.

All of the materials needed in addition to the shipping containers for construction of the modular elements may be placed within the shipping containers and then delivered to the building site where the modular element(s) and transportable building are constructed. In one embodiment, the shipping containers may be modified into modular elements that contain a plurality of individual units at a remote site and then delivered to a site for installation as a transportable building. At the installation site, the modular elements may be set in place on a foundation and sealed to form the transportable building.

Modular elements may be joined in a vertical array to produce any of various arrangements for a second or higher level in the transportable building.

Each transportable building may contain electrical, insulation, HVAC and architectural features as needed and/or desired for each environment, as selected by the owner or as mandated by applicable building code. The transportable building may be further improved with the installation of decorative interior walls, weather-resistant exterior covering, exterior security lights or any features as determined by the owner.

The only permanent structures that are required for installation of the transportable building are the footings upon which to place the modular elements. The transportable buildings can be built with a small investment in materials and labor. The transportable building can be dismantled, then easily transported to a new location. The footings may be removed, leaving the land in its original condition.

Turning to the figures. FIG. 1 depicts a standard intermodal shipping container 100.

Figure 2A:
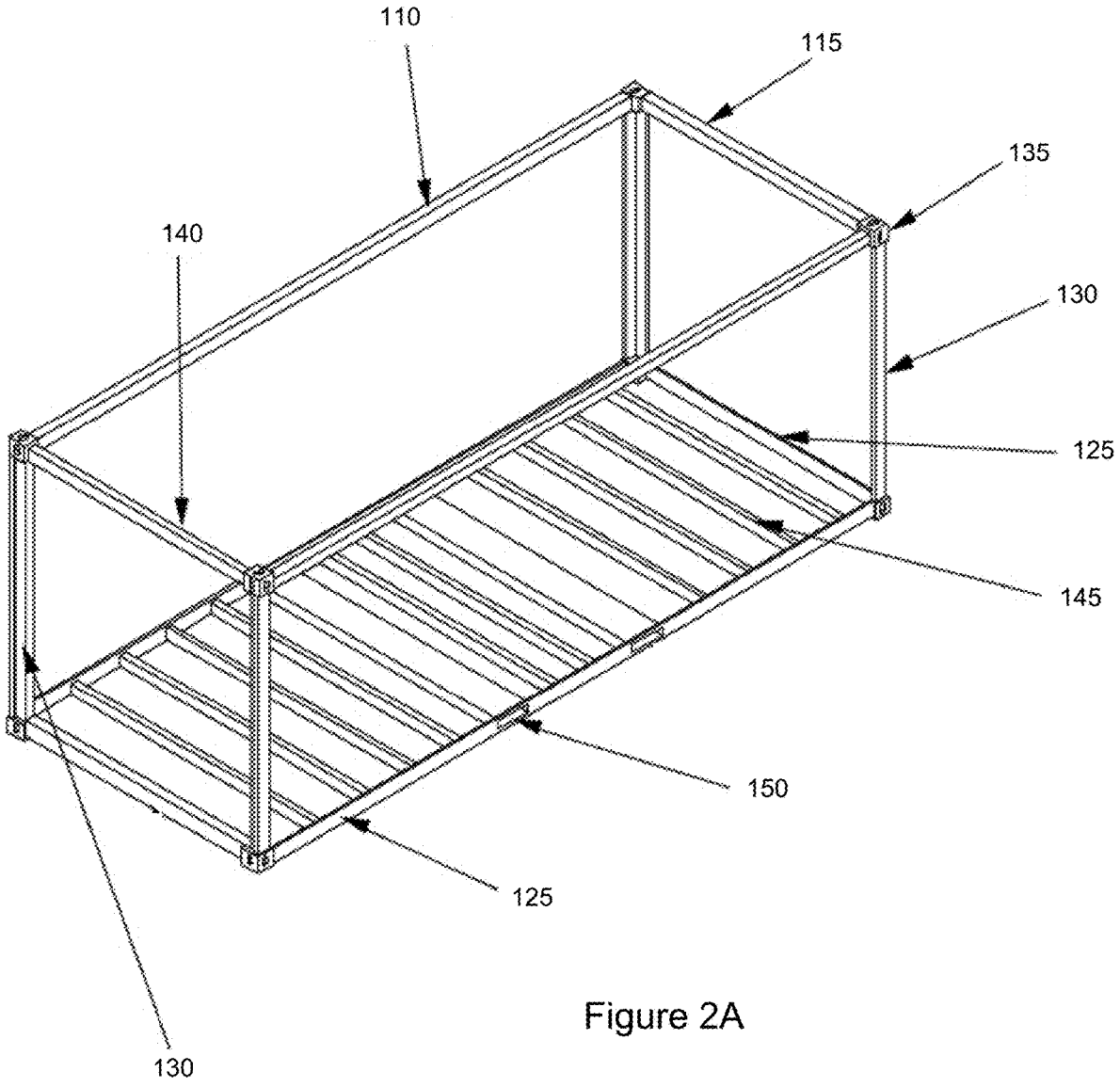
FIG. 2A depicts the understructure of a standard intermodal shipping container.

FIG. 2A depicts the understructure of standard intermodal shipping container 100 comprising top side rail 110; top end rail 115; bottom side rail 120; bottom end rail 125; cross member 145; forklift pocket 150.

Figure 2B:
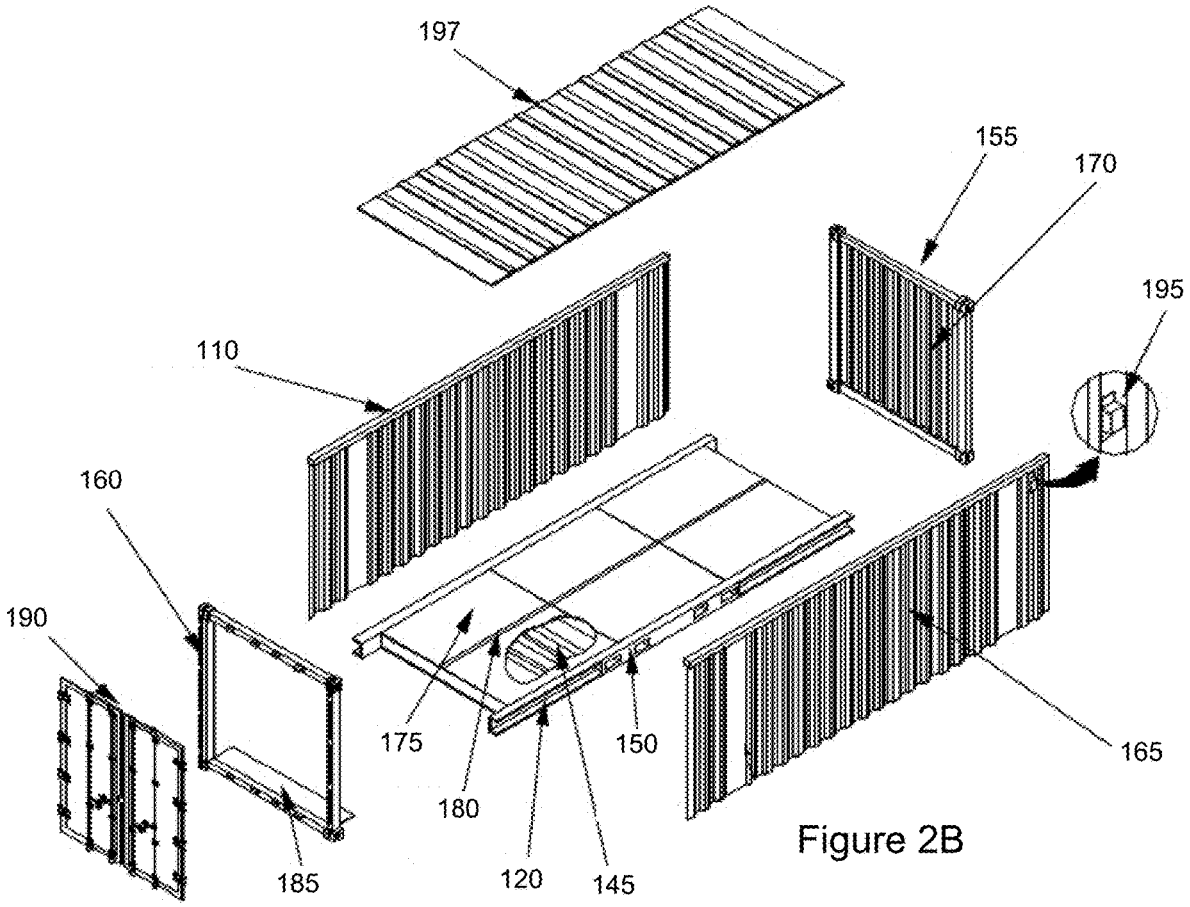
FIG. 2B depicts an exploded view of the various components of an intermodal shipping container.

FIG. 2B depicts an exploded view of the various components of intermodal shipping container 100 comprising top side rail 110; bottom side rail 120; corner post 130; corner fitting 135; door header 140; cross member 145; forklift pocket 150; front end frame 155; rear end frame 160; sidewall panel 165; endwall panel 170; flooring 175; joint strip 180; threshold plate 185; door assembly 190; ventilator 195; and roof panel 197.

Figure 3A:
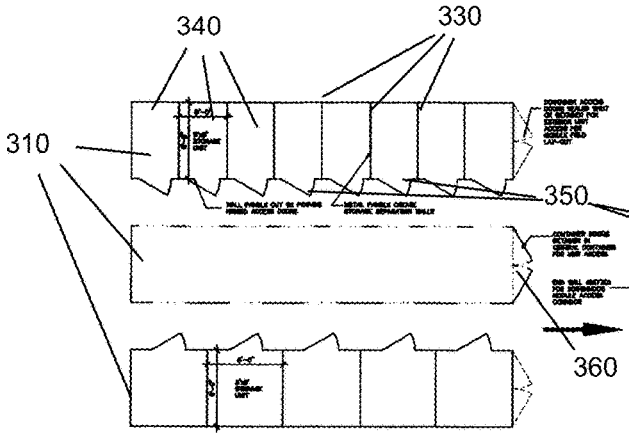
FIG. 3A depicts three shipping containers to be assembled into a modular element according to one embodiment of the invention.

FIG. 3A depicts three shipping containers 310 to be assembled into a modular element 320 according to one embodiment of the invention. Each modular element 320 comprises an inner shipping container and two outer shipping containers. A plurality of walls 330 are constructed in each outer shipping container to form a plurality of individual units 340. A doorway 350 is cut into the wall 330 corresponding to each individual unit 340 to allow entry to allow for the hanging of doors. An entryway 360 is built at one end of the inner shipping container to allow entry into the transportable building and the individual units 340.

Figure 3B:
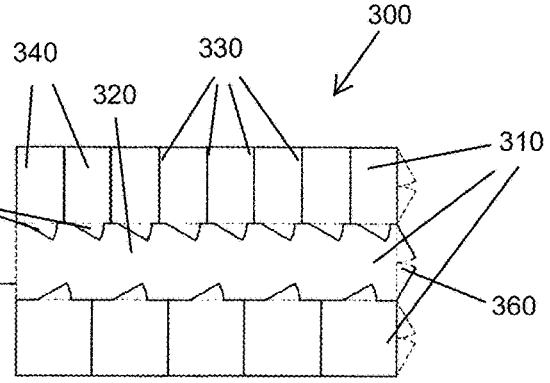
FIG. 3B depicts a transportable building comprising a single modular element according to one embodiment of the invention.

FIG. 3B depicts a transportable building 300 assembled from a single modular element 320 made from three shipping containers 310 according to one embodiment of the invention.

Figure 3C:
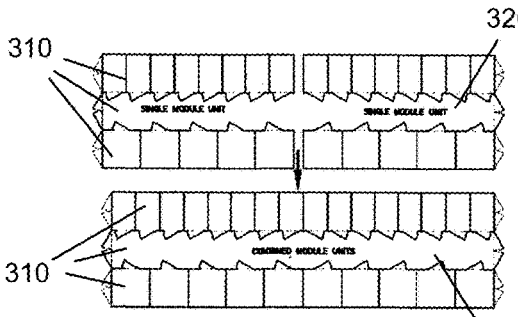
FIG. 3C depicts two modular elements to be assembled into a transportable building according to one embodiment of the invention.

FIG. 3C depicts two modular elements 320, each made from three shipping containers 310, to be assembled into a transportable building according to one embodiment of the invention.

Figure 3D:
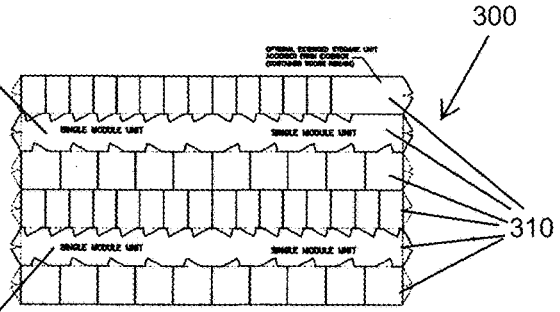
FIG. 3D depicts a transportable building comprising two modular elements assembled side-by-side according to one embodiment of the invention.

FIG. 3D depicts a transportable building 300 comprising two modular elements 320, each made from three shipping containers 310, assembled side-by-side according to one embodiment of the invention.

The foregoing embodiments have been presented for the purpose of illustration and description only and are not to be construed as limiting the scope of the invention in any way. The scope of the invention is to be determined from the claims appended hereto.

What is claimed is:

1. A method of manufacturing a transportable building, comprising:

forming a transportable building by arranging one or more modular elements, each modular element comprising three standard intermodal shipping containers arranged in side-by-side abutment such that each modular element comprises two outer standard intermodal shipping containers and one inner standard intermodal shipping container wherein an interior space is defined by abutment of the standard intermodal shipping containers, wherein each modular element comprises a structural frame and a plurality of features in addition to the structural frame, wherein the structural frame of each modular element consists of the understructure of the three standard intermodal shipping containers, wherein the understructure of each standard intermodal shipping container consists of four (4) vertical structure members, or corner posts, extending the height of each standard intermodal shipping container; two (2) top end rails extending between two (2) corner posts at the top of the corner post at each end of each standard intermodal shipping container and two (2) bottom end rails extending between two (2) corner posts at the bottom of the corner post at each end of each standard intermodal shipping container, thus forming a front end frame and a rear end frame; two (2) top side rails extending between two (2) corner posts at the top of the front end frame and two (2) bottom side rails extending between two (2) corner posts of the bottom end frame; and a plurality of cross members for supporting flooring extending between the two (2) bottom side rails, wherein the top end rails, the bottom end rails, the top side rails and the bottom side rails are connected to the corner posts by a corner fitting, wherein the corner posts, the top end rails, the bottom end rails, the top side rails, and the bottom side rails each have four (4) exterior faces disposed at substantially right angles, wherein the understructure complies with requirements as specified in ISO 1161 as that ISO existed on May 28, 2016;

wherein the points of abutment of the standard intermodal shipping containers comprising the modular elements consist solely of the corner posts and one or more rooflines, wherein the one or more rooflines consist of the top end rails, the top side rails, and a combination of the top end rails and the top side rails, wherein further the standard intermodal shipping containers comprising the modular elements are sealed at the points of abutment solely by bolts;

wherein each intermodal shipping container meets the certification criteria of ISO 1161 for transport of cargo, wherein each intermodal shipping container comprises a standard ISO shipping container that has been previously used for transport and storage for moving products or raw materials between locations or countries that has been taken out of such service, wherein each modular element further comprises two (2) sidewall panels disposed vertically between the two (2) top side rails and the two (2) bottom side rails of each standard intermodal shipping container, wherein each modular element further comprises two (2) endwall panels disposed vertically between the two (2) top end rails and the two (2) bottom end rails of each standard intermodal shipping container, wherein further the plurality of features in addition to the structural frame of each of the one or more modular elements comprise:

an entryway into the interior space and disposed at one endwall panel of each of the inner shipping containers;

electrical service;

insulation; and a plurality of walls disposed to extend between the two (2) sidewall panels of each of the outer standard intermodal shipping containers to form a plurality of individual units, wherein further a cavity is cut into one of the sidewall panels of each of the outer standard intermodal shipping containers corresponding to each individual unit.

2. The method of claim 1 wherein at least one modular element further comprises HVAC.

3. The method of claim 1 wherein at least one modular element further comprises security features at the entryway to permit entrance into the interior space.

4. The method of claim 3, wherein the security features comprise one or more of locks, passwords, biometrics, card swipes and combinations thereof.

5. The method of claim 3, further comprising exterior safety lights.

6. The method of claim 1, wherein the transportable building further comprises a foundation upon which the modular elements are supported.

7. The method of claim 6, wherein the foundation comprises a plurality of concrete footings.

8. The method of claim 1, wherein the transportable building comprises one modular element.

9. The method of claim 1, wherein the transportable building comprises two modular elements.

10. The method of claim 9, wherein the two modular elements are in side-by-side abutting configuration.

11. The method of claim 9, wherein the two modular elements are in end-to-end abutting configuration.

12. The method of claim 1, wherein the bolts are 1 inch in diameter.

13. The method of claim 1, wherein one or modular elements are joined in a vertical array.

* * * * *